US005369838A

United States Patent [19]

Wood et al.

[11] Patent Number: 5,369,838

[45] Date of Patent: Dec. 6, 1994

[54] AUTOMATIC FLOOR SCRUBBER

[75] Inventors: David W. Wood, Rockford; Donald J. Legatt, St. Michael; William F. Allen, Wayzata, all of Minn.

[73] Assignee: Advance Machine Company, Plymouth, Minn.

[21] Appl. No.: 977,216

[22] Filed: Nov. 16, 1992

[51] Int. Cl.[5] ..... H47L 11/30

[52] U.S. Cl. ..... 15/320; 15/340.1; 15/326; 15/353; 15/385; 248/638

[58] Field of Search ..... 15/320, 401, 50.1, 98, 15/326, 353, 354, 359, 340.1, 385; 248/615, 638, 634

[56] References Cited

U.S. PATENT DOCUMENTS

| | | | |
|---|---|---|---|
| 2,095,466 | 10/1937 | Cummings | 15/326 |
| 2,125,850 | 8/1938 | Norris | 15/326 |
| 2,253,310 | 8/1941 | Smellie | 15/326 |
| 3,575,288 | 4/1971 | Brucken | 248/615 |
| 3,609,787 | 10/1971 | Aurelio et al. | 15/320 X |
| 3,803,666 | 4/1974 | Sawyer | 15/320 |
| 4,000,536 | 1/1977 | Nayfa et al. | 15/50 A |
| 4,006,506 | 2/1977 | Burgoon | 15/320 X |
| 4,380,844 | 4/1983 | Waldhauser et al. | 15/320 |
| 4,713,714 | 12/1987 | Gatti et al. | 248/638 X |
| 4,718,631 | 1/1988 | Reynolds et al. | 248/615 |
| 4,744,539 | 5/1988 | Stimeling | 248/638 |
| 4,803,753 | 2/1989 | Palmer | 15/320 X |
| 4,805,256 | 2/1989 | Mason et al. | 15/320 |
| 4,854,005 | 8/1989 | Wiese et al. | 15/320 |
| 4,871,142 | 10/1989 | deMey, II | 248/632 |
| 5,040,953 | 8/1991 | Tinsler | 417/363 |
| 5,054,158 | 10/1991 | Williams et al. | 15/354 |

*Primary Examiner*—David A. Scherbel
*Assistant Examiner*—Patrick F. Brinson
*Attorney, Agent, or Firm*—Peterson, Wicks, Nemer & Kamrath

[57] ABSTRACT

An automatic floor scrubber (10) is disclosed having its frame divided into a truck (12) and an upper assembly (14) isolated from each other by a multiplicity of elastomeric isolator mounts (106) arranged in a nonlinear fashion. The wheels (18, 20), the drive motor (22), the squeegee system (26), and the brush scrub system (28) are mounted to the subframe (16) of the truck (12). The control handle (46), solution tanks (48, 50), and batteries (74) are mounted to the chassis (44) of the upper assembly (14). The mounts (106) include integral first and second portions (108, 110), with the first portion (108) sandwiched between the subframe (16) and the chassis (44) and the second portion (110) insertable into a mount aperture (118) and axially compressed into a mushroom shape by bolts (122) to capture the mount aperture (118). An acoustical tunnel (84) extends longitudinally in the chassis (44) intermediate the batteries (74) and defines a closed volume lined with foam sheets (88). The outlet hose (104) of the vacuum system (52) extends through the open end of the tunnel (84) and exhausts the air therein, with the air escaping from the closed volume flowing around the outlet hose (104) and through the open end of the tunnel (84).

21 Claims, 2 Drawing Sheets

AUTOMATIC FLOOR SCRUBBER

BACKGROUND

The present invention generally relates to equipment for the floor-care industry, particularly to automatic floor scrubbers, and specifically to automatic floor scrubbers including unique provisions for dampening the vibrations caused by the machine moving over a rough surface and/or provisions for reducing the sound level generated during operation.

An automatic floor scrubber is a commonly used piece of equipment in the floor-care industry. The machine is generally comprised of a tank to hold cleaning solution, a scrub system to agitate the solution on the floor surface in order to loosen dirt, a vacuum squeegee system to pick up the dirty solution, and a tank to contain the dirty solution. The larger automatic floor scrubbers are usually battery powered, and, because the batteries weigh a substantial amount, are equipped with a traction drive system to propel the machine across the floor.

In use, the automatic floor scrubber is used to scrub aisles, hallways, and the like, and to scrub close to objects. Therefore, the automatic floor scrubber is used on a variety of floors, such as smooth tile or concrete, ceramic tile, or rough concrete, so it is advantageous both from the standpoint of operator and machine to provide a means of dampening the vibrations caused by the machine moving over a rough surface. Current means for providing dampening in automatic floor scrubbers has been utilizing cushion tires. However, cushion tires have a lower load rating than a noncushion tire for a given size, so the tire size must be substantially increased. This necessitates a less compact machine, causing potential maneuvering difficulties. Alternately, spring caster wheels, which provide a degree of suspension, have been utilized for dampening in automatic floor scrubbers. These spring casters, however, are very expensive, and in many cases are not economically feasible.

Additionally, automatic floor scrubbers are often utilized in areas where excessive noise is undesirable, such as hospitals or nursing homes, so the machine needs to be as quiet as possible in operation. The vacuum system creates most of the noise generated by automatic floor scrubbers. Current means of reducing the sound level is to attach a porous, open-cell acoustical foam tube onto the outlet port of the vacuum system. However, since the automatic floor scrubbers are designed to be as compact as possible, the length of the tube could not be any substantial length, resulting in a compromise in sound level reduction.

Thus, a need exists for improved methods of providing dampening of the vibrations caused by floor-care equipment moving over rough surfaces. Additionally, a need exists for improved methods of reducing the sound level generated by the vacuum system of floor-care equipment.

SUMMARY

The present invention solves these needs and other problems in the field of floor care by providing, in the most preferred form, a multiplicity of elastomeric isolator mounts mounted between a truck and an upper assembly of a floor cleaning machine in a nonlinear fashion, with the truck including the wheels or the like for movably supporting the floor cleaning machine, with the upper assembly carrying a tank for holding floor cleaning solution, with the elastomeric isolator mounts dampening the transmission of vibrations between the truck and the upper assembly.

In a further aspect of the present invention, the truck mounts the wheels or the like, the drive motor, and the floor scrubbing system, and the upper assembly carries the tanks and the control handle and in the most preferred form the batteries, with suspension means between the truck and the subframe which in the most preferred form are elastomeric isolator mounts dampening the transmission of vibrations between the truck and the upper assembly.

In another aspect of the present invention, an acoustical tunnel is provided defining a closed volume preventing escape of air therethrough and into which the air of the outlet of the vacuum system is exhausted and from which the air escapes in a direction generally opposite to the direction that the air is introduced by the outlet, with the closed volume being covered by sound reducing material to reduce the sound level generated by the vacuum system.

It is thus an object of the present invention to provide a novel floor cleaning machine where the wheels or like structure for movably supporting the machine on the floor are isolated from the heaviest components of the machine and the control handle by a multiplicity of elastomeric isolator mounts arranged in a nonlinear fashion.

It is thus an object of the present invention to provide a novel floor cleaning machine where the frame is divided into a truck and an upper assembly, with the truck mounting the major sources of vibration including the wheels or the like, the drive motor, and the scrub system, and where the floor cleaning machine includes a suspension system which dampens the transmission of vibrations between the truck and the upper assembly.

It is thus an object of the present invention to provide a novel sound level reduction for the vacuum system.

It is further an object of the present invention to provide such a novel floor cleaning machine having elastomeric isolator mounts which attach the subframe and chassis together.

It is further an object of the present invention to provide such a novel floor cleaning machine extending the life of components and especially the batteries.

It is further an object of the present invention to provide such a novel floor cleaning machine having a high level of operator comfort.

It is further an object of the present invention to provide such a novel floor cleaning machine having reduced chance of floor surface damage.

It is further an object of the present invention to provide such a novel floor cleaning machine dampening vibration forces which move the subframe and chassis together or apart.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
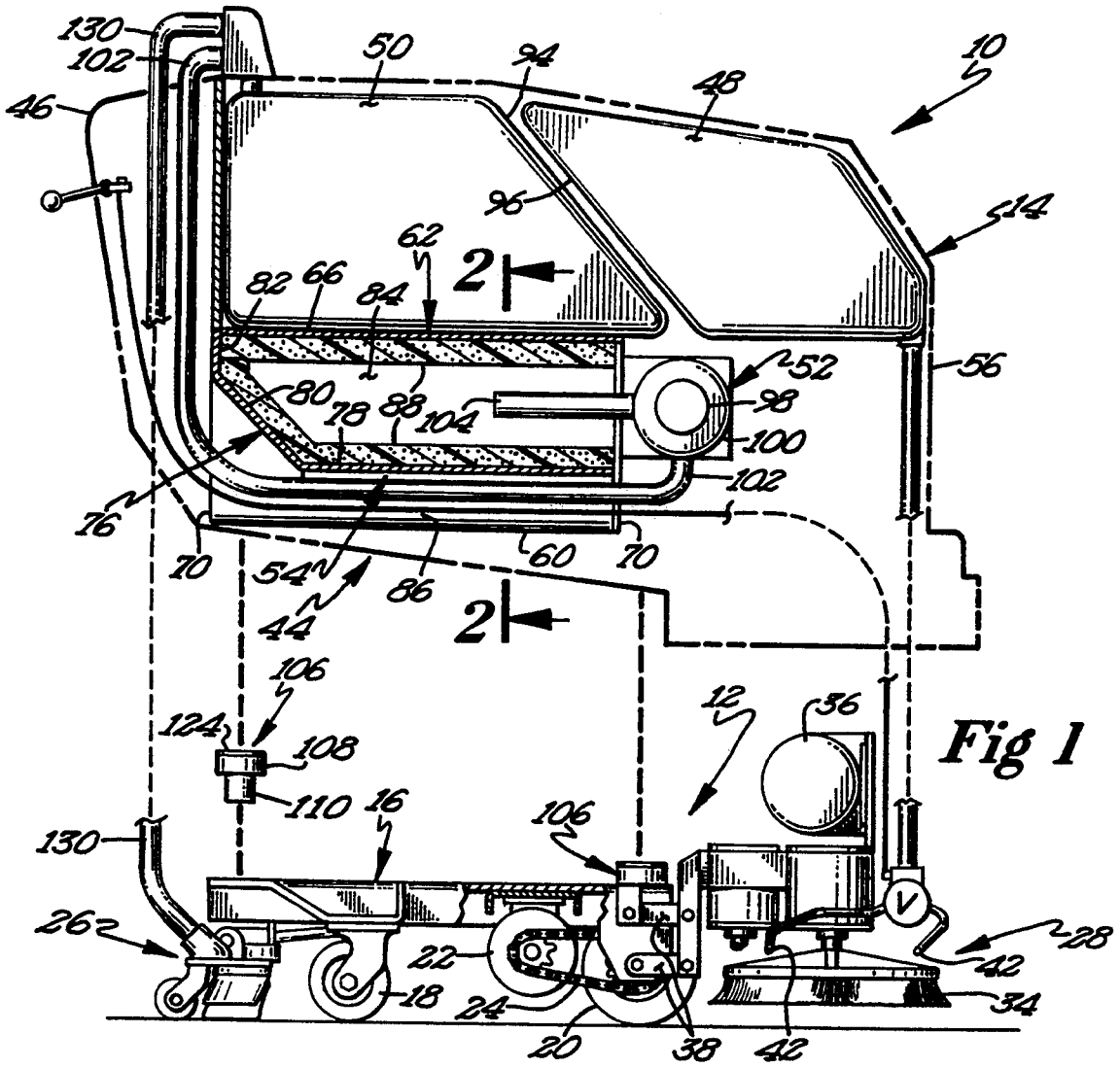
FIG. 1 shows an exploded, side-elevational view of an automatic floor scrubber according to the preferred teachings of the present invention, with portions broken away to show constructional details.
Figure 2:
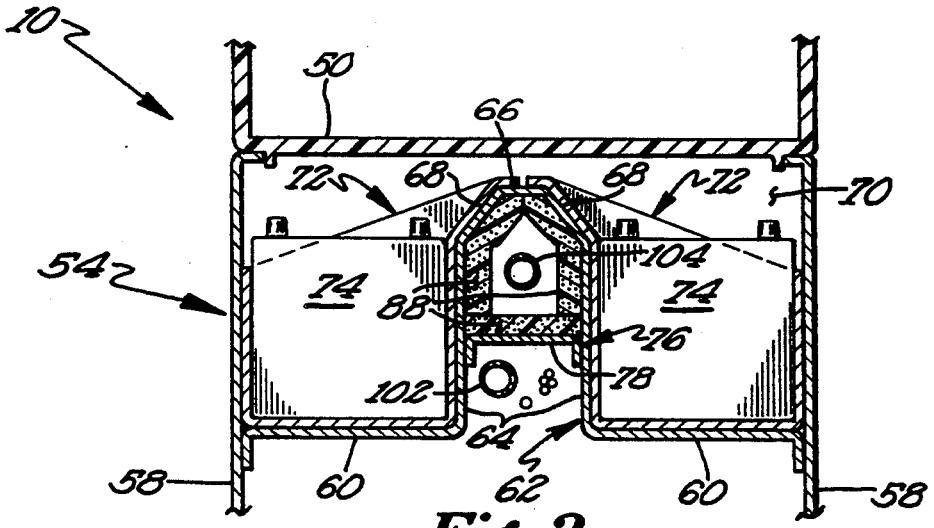
FIG. 2 shows a cross-sectional view of the automatic floor scrubber of FIG. 1 according to section line 2—2 of FIG. 1.
Figure 4:
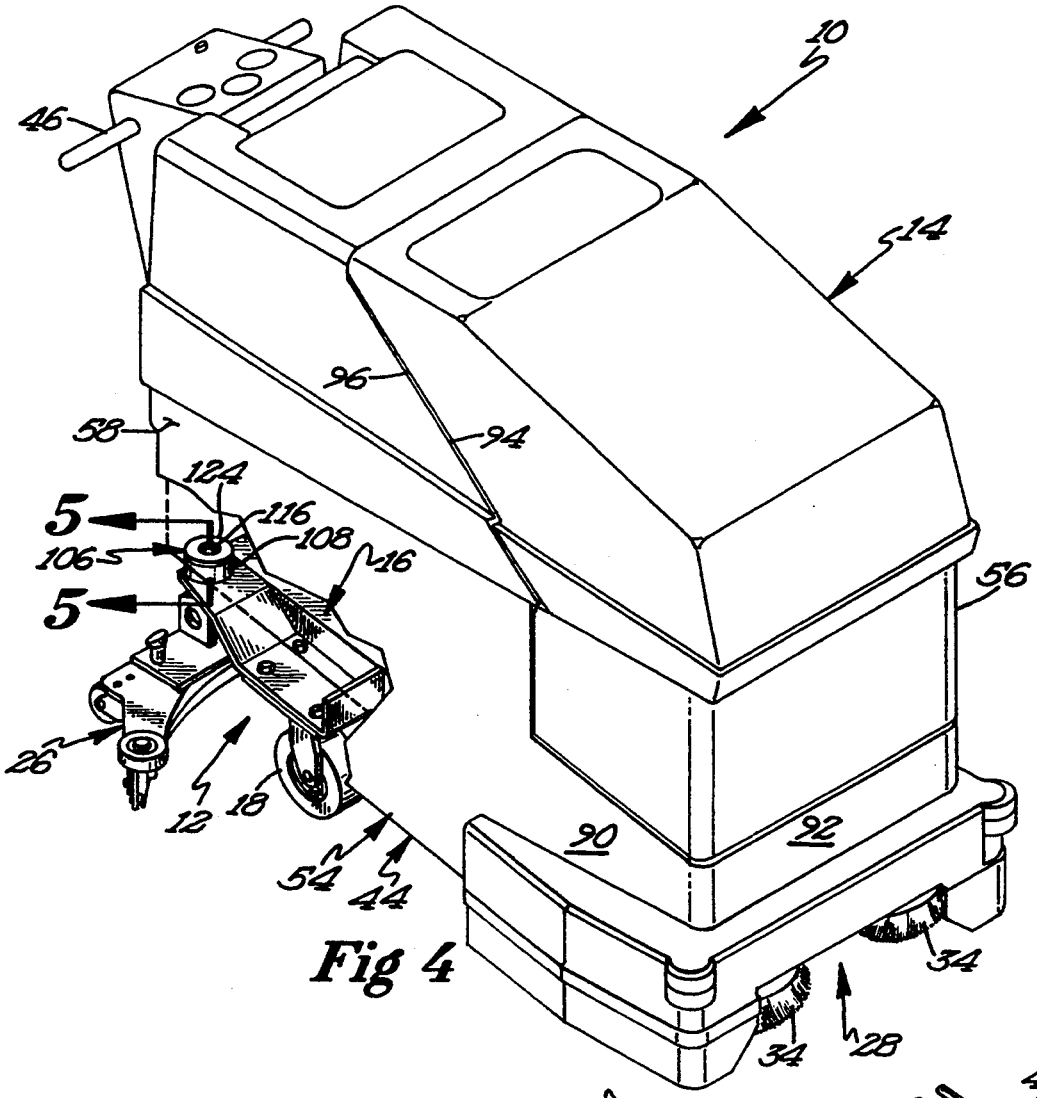
FIG. 4 shows a perspective view of the automatic floor scrubber of FIG. 1, with portions broken away to show constructional details.
Figure 5:
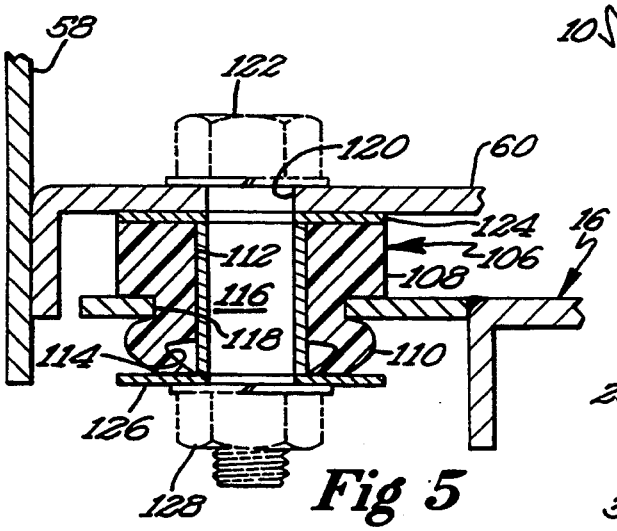
FIG. 5 shows a cross-sectional view of an elastomeric isolator mount, according to the preferred teachings of the present invention, of the automatic floor scrubber of FIG. 1 according to section line 5—5 of FIG. 4.
Figure 3:
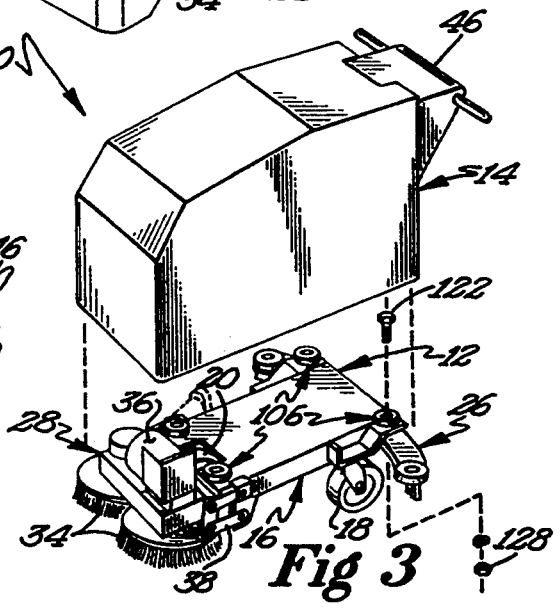
FIG. 3 shows a diagramatic, exploded perspective view of the automatic floor scrubber of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "outer", "inner", "upper", "lower", "height", "width", "end", "side", "horizontal", "vertical", "longitudinal", and similar terms are used herein, it should be understood that these terms have reference only to the structure shown in the drawings as it would appear to a person viewing the drawings and are utilized only to facilitate describing the invention.

DESCRIPTION

An automatic floor scrubber according to the preferred teachings of the present invention is shown in the drawings and generally designated 10. Generally, scrubber 10 includes in the preferred form a frame which is divided into sections and in the most preferred form into a truck 12 which movably supports an upper assembly 14. Truck 12 generally includes a subframe 16 to which is attached first and second caster wheels 18, drive wheel 20, drive motor 22 having a suitable power transfer mechanism such as a roller chain 24 shown to wheel 20 for moving subframe 16 upon the floor, vacuum squeegee system 26, and brush or scrub system 28. Wheels 18 and 20 movably support subframe 16 and scrubber 10 upon the floor.

Squeegee system 26 can be of any desired construction such as a squeegee assembly having a breakaway mount. Squeegee system 26 can be mounted to truck 12 by any suitable construction such as a longitudinally extending tongue having its free end pivotally mounted to subframe 16 about a vertically extending axis. Additionally, squeegee system 26 can be movable between a floor-engaging position and a transport position by any suitable construction.

In the most preferred form, brush system 28 generally includes first and second brushes 34 rotatably mounted about longitudinally staggered, vertical axes. Brushes 34 are rotated by suitable drive means 36 including a motor. Brushes 34 and drive means 36 are mounted for vertical movement away from and towards the floor such as by a parallel linkage 38 as shown and movable by a suitable actuator. Brush system 28 further includes suitable means such as nozzles 42 for dispensing cleaning solution upon the floor surface for agitation by brushes 34.

Upper assembly 14 generally includes a chassis 44, an operator control handle 46, clean solution tank 48, solution recovery tank 50, and vacuum system 52. Generally, chassis 44 includes a battery compartment 54 and a mechanical compartment 56. In the preferred form, battery compartment 54 has a size corresponding to subframe 16 and has a lateral cross section of a generally W-configuration. Specifically, battery compartment 54 generally includes first and second, spaced, parallel side walls 58 of a generally rectangular configuration. Bottom wall 60 extends generally perpendicularly between side walls 58 and includes an upraised, longitudinally extending channel 62 having gable-shaped cross sections and extending generally parallel to and intermediate side walls 58. Specifically, channel 62 includes first and second longitudinally and vertically extending sides 64 extending generally parallel to and spaced from side walls 58. Channel 62 further includes a longitudinally and horizontally extending top 66 extending generally perpendicular to side walls 58 and having a width which is substantially less than the spacing between sides 64. Channel 62 further includes first and second longitudinally extending angular plates 68 integrally extending angularly outwardly from the side edges of top 66 to the top edges of sides 64, with top 66 located generally intermediate and above sides 64. Battery compartment 54 further generally includes first and second, spaced, parallel, end walls 70 extending generally perpendicular between side walls 58 and of a generally rectangular configuration but having openings corresponding to channel 62.

First and second battery trays 72 are provided having a shape complementary to and for slideable receipt between side walls 58 and channel 62 and between end walls 70 and having a height generally equal to the height of channel 62. Battery trays 72 in turn slideably receive suitable batteries 74 providing electric power for scrubber 10 and specifically for motors 22 and 36, the actuator for linkage 38, and vacuum system 52, with two sets of batteries 74 being provided in the most preferred form parallel to, adjacent, and on opposite sides of channel 62. It should then be noted that battery trays 72 have a shape complementary to channel 62, with angular plates 68 allowing for ease of receipt and removal of batteries 74 in trays 72 and between side walls 58 and channel 62.

Chassis 44 further includes a baffle plate 76 slideably received and secured in channel 62. Specifically, baffle plate 76 includes a horizontally extending bottom plate 78 extending between sides 64 spaced from, parallel to and intermediate top 66 and bottom wall 60. Baffle plate 76 further includes an end including a first angled portion 80 extending at an acute angle in the preferred form in the order of 45° from plate 78 and a second vertical portion 82 extending from angled portion 80 and interconnected to the end edges of top 66 and angular plates 68 and to rear end wall 70, with the interconnection of portions 80 and 82 corresponding to the interconnection of sides 64 and angular plates 68 in the most preferred form. It can then be appreciated that channel 62 and baffle plate 76 define first and second, longitudinally extending, elongated tunnels 84 and 86 in chassis 44 of the frame of floor scrubber 10, with tunnels 84 and 86 extending approximately two-thirds the length of scrubber 10 in the preferred form. First tunnel 84 has a single open end at the front end wall 70 and defines a closed volume preventing escape of air therethrough as the sides, top, bottom, and opposite end at the rear end wall 70 are closed. Second tunnel 86 has open ends at both the front and rear end walls 70 and has an open bottom, with the top and sides being closed. Tunnel 84 is lined by and the closed volume defined thereby is covered by sound-reducing material. Specifically, in the most preferred form, three acoustical foam sheets 88 are provided in tunnel 84 with one sheet extending over and covering baffle plate 76 and the other two sheets extending over and covering sides 64, top 66, and angular plates 68 of channel 62 inside of tunnel 84.

Mechanical compartment 56 generally includes first and second side walls 90 extending contiguously from side walls 58 and an end wall 92 expending generally perpendicularly between side walls 90 and parallel to and spaced from the front end wall 70 of battery compartment 54. In the most preferred form, mechanical compartment 56 is formed into two components, with the lower component being integrally connected to battery compartment 54 and the upper component being removably connected to battery compartment 54.

Recovery tank 50 rests and is carried by the upper ends of side walls 58 and end walls 70 of battery compartment 54 of chassis 44. In the most preferred form, the front wall 94 of tank 50 angles rearwardly and upwardly from the front end wall 70. Tank 48 rests upon and is carried by the upper ends of side walls 90 and end wall 92 of mechanical compartment 56 and upon front wall 94 of tank 50, with the rear wall 96 of tank 48 and front wall 94 of tank 50 having a suitable slideable interconnect therebetween.

In the most preferred form, control handle 46 is secured to and abuts with rear end wall 70 of chassis 44. In the most preferred form, handle 46 extends over and encloses the open end of channel 62 formed in the rear end wall 70 of chassis 44.

Vacuum system 52 generally includes a motor 98 which drives a fan 100. Conduit means in the preferred form of a hose 102 extends from and is in fluid communication with tank 50, extends into and down control handle 46, extends into tunnel 86 following angled portion 80 and bottom plate 78 of baffle plate 76, and extends to and is in fluid communication with the inlet of fan 100. The outlet of fan 100 is in fluid communication with tunnel 84 by an outlet hose 104 which extends from and is in fluid communication with the outlet of fan 100 and extends through the open end of and into tunnel 84 in the range of one-fourth to one-third the longitudinal extent of tunnel 84. The cross-sectional area of outlet hose 104 is substantially smaller than the cross-sectional area of the inner surface of foam sheets 88 lining tunnel 84. Conduit means in the form of hose 130 extends between vacuum squeegee system 26 and tank 50.

In operation of vacuum system 52, air is drawn from tank 50 by fan 100 through hose 102. Thus, tank 50 is placed under vacuum and in turn air and solution is drawn from vacuum squeegee system 26 into tank 50. Air drawn through hose 102 and into the inlet of fan 100 in turn is blown by fan 100 through outlet hose 104 into tunnel 84. Air escapes from tunnel 84 in a direction generally opposite to the direction that air is introduced by hose 104 into tunnel 84 and in the preferred form by flowing around outlet 104 of fan 100 and through the open end of tunnel 84. This constructional relationship provides a very effective means of noise level reduction. Specifically, the noise is exposed to a very large surface area and thickness of acoustical foam sheets 88 which line tunnel 84 running front-to-back approximately two-thirds the length of floor scrubber 10, with surface area being important for absorbing high frequency noise and thickness being important for absorbing low frequency noise. Additionally, the large cross-sectional area of tunnel 84 allows the velocity of air exiting outlet 104 of fan 100 to be lowered before it leaves tunnel 84 through the open end of tunnel 84, allowing a higher degree of sound level absorption by foam sheets 88 lining tunnel 84. Thus, the noise created by vacuum system 52 is substantially reduced utilizing the teachings of the present invention. As vacuum system 52 is a major source of noise, the overall sound level of floor scrubber 10 is thereby reduced.

In the preferred form of the present invention, truck 12 and upper assembly 14 are attached together but isolated from each other by a suspension system for dampening the transmission of vibrations therebetween which in the preferred form includes a multiplicity of elastomeric isolator mounts 106. In the most preferred form, mounts 106 are supplied by the Industrial Products Division of Lord Corporation of Erie, Pa. Each mount 106 includes first and second cylindrical portions 108 and 110 integrally secured together end for end and along the same axis, with portions 108 and 110 formed from an elastomeric material. The diameter of portion 108 is larger than portion 110. The length of portion 108 is shorter than portion 110. An axial bore 112 extends through portions 108 and 110. An axial counterbore 114 of a larger diameter than bore 112 extends into portion 110 from the free axial end of portion 110 towards but spaced from portion 108. A rigid metal bushing 116 is positioned in axial bore 112 from the free axial end of portion 108 to counterbore 114. Subframe 16 of truck 12 includes a multiplicity of mount apertures 118 arranged in a nonlinear fashion, with four shown in the most preferred form arranged in the corners of a parallelepiped. Apertures 118 have a size and shape for a relatively tight slideable receipt of portion 110 but smaller than portion 108. Bottom wall 60 of chassis 44 includes a multiplicity of securement apertures 120 located complementary to apertures 118. Apertures 120 slideably receive bolts 122, with each bolt 122 extending through a washer 124 sandwiched between bottom wall 60 and portion 108, through bushing 116, through counterbore 114, and through a washer 126 sandwiched between portion 110. A nut 128 is threadably received on the end of bolts 122. Portions 108 of mounts 106 are sandwiched between subframe 16 of truck 12 and bottom wall 60 of chassis 44 of upper assembly 14. By tightening nut 128 and thus decreasing the effective length between the head of bolt 122 abutting with bottom wall 60 and nut 128 abutting with washer 126 and thereby moving washer 126 towards portion 108, portion 110 is selectively and adjustably expandable in aperture 118 to capture aperture 118. Specifically, portion 110 will axially compress into a mushroom shape to capture subframe 16 inside of aperture 118 and between portion 108 and the head of mushroom shaped, compressed portion 110. It should be noted that counterbore 114 allows for ease of axial compression into the mushroom shape due to the reduced material between the outside surface of portion 110 and counterbore 114. It should then be noted that bolts 122 do not have direct or indirect metal-to-metal contact with truck 12 as mount 106 formed of elastomeric material is the sole source of contact with truck 12 in the most preferred form.

In the most preferred form with battery compartment 54 of a size corresponding to subframe 16 and extending substantially two-thirds the length of scrubber 10, brush system 28 mounted on truck 12 is positioned and movable within mechanical compartment 56. The electrical and other controls for motors 36 and 100, for the actuator for raising and lowering linkage 38 of scrub system 28, for turning off and on the flow of solution to brush system 28 and the like can be positioned inside of tunnel 86 adjacent to hose 102. It can then be appreciated that truck 12 can be manufactured as a separate subassembly and that upper assembly 14 can also be generally manufactured as a separate subassembly. Such subassembly construction allows for ease of manufacture and inventory and allows components such as squeegee system 26 and/or brush system 28 to be varied during manufacture of truck 12 depending upon the particular floor surface upon which scrubber 10 is to be utilized and/or allows different sizes and configurations of upper assemblies 14 to be utilized with separately assembled trucks 12. After assembly of such separate subassemblies has been completed, they can be easily attached together utilizing mounts 106, at which time the controls can be interconnected between truck 12 and upper assembly 14. Thereafter, the remaining assembly of upper assembly 14 and of floor scrubber 10 can be completed. It should then be noted that the provision of tunnel 86 is especially advantageous in such subassembly manufacture as it protects hose 102 and the controls positioned therein during assembly of upper assembly 14 and during attachment to truck 12.

It can be appreciated that truck 12 is subjected to vibrations from various sources. Specifically, vibrations are generated by caster wheels 18 and drive wheel 20 rolling over uneven floor conditions such as encountered when scrubber 10 is utilized to clean a tile floor, a concrete floor having expansion joints, or like floors, or when scrubber 10 cleans over thresholds, elevator doorways, or similar bumps and depressions, with wheels 18 and 20 rolling over and in the crevices, bumps and depressions. Additionally, vibrations are generated by the rotation of brushes 34 in brush system 28. Further vibrations are generated by operation of motor 36 of brush system 28 and of drive motor 22. According to the teachings of the present invention, vibrations subjected to truck 12 are isolated from and generally not transmitted to upper assembly 14 due to elastomeric isolator mounts 106 between truck 12 and upper assembly 14 and arranged in a nonlinear fashion. This results in several advantages. First, as shock loading has been greatly reduced, extended component life is obtained. This is especially important when floor scrubber 10 is powered by batteries 74 as vibration of batteries 74 can cause electrical plate damage and significant shorter life. Also, as control handle 46 is mounted on upper assembly 14 and isolated from vibrations of truck 12, a higher level of operator comfort is obtained. Additionally, as batteries 74 and the solution in tanks 48 and 50 which comprise the heaviest components of floor scrubber 10 are isolated from wheels 18 and 20 which movably support scrubber 10 upon the floor surface, there is less chance of damage to the floor surface.

It should further be noted that elastomeric isolator mounts 106 for dampening vibrations do not encounter many problems encountered by springs in resilient support systems. Specifically, spring constants vary between springs and during the life of the spring. Thus, accurate and consistent performance of spring supports are expensive and difficult to obtain and maintain over the life of the machine, and often require spring replacement during the life of the machine. Also, springs generally act through compression to prevent two objects from moving together but generally do not prevent objects from moving apart, with rigid stops being provided to prevent separation beyond a maximum amount. Thus, spring supports do not tend to dampen forces which cause separation. Additionally, direct metal-to-metal contact is made by the bolt to the flanges which slideably receive the bolt holding the spring and indirect metal-to-metal contact is further made through the spring itself, with such metal-to-metal contact transmitting vibrations. However, according to the teachings of the present invention, mounts 106 are relatively easy and inexpensive to manufacture and maintain their dampening characteristics over the life of the machine and act whether the forces tend to move truck 12 and upper assembly 14 together or apart without direct or indirect metal-to-metal contact.

Now that the basic teachings of the present invention have been explained, many extensions and variations will be obvious to one skilled in the art. For example, mounts 106 can be inverted according to the teachings of the present invention with mount apertures 118 formed in bottom wall 60 of chassis 44 of upper assembly 14 and securement apertures 120 formed in subframe 16 of truck 12. Likewise, other types and forms of elastomeric isolator mounts 106 can be utilized according to the preferred teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Machine for cleaning floors comprising, in combination: a truck comprising, in combination: a subframe, means mounted to the subframe for movably supporting the subframe upon the floor, means mounted to the subframe for moving the subframe upon the floor, and means mounted to the subframe for scrubbing the floor; an upper assembly comprising, in combination: a chassis, at least a first tank carried by the chassis for holding floor cleaning solution, and a control handle mounted to the chassis; and suspension means between the subframe and the chassis for mounting the chassis to the subframe and dampening the transmission of vibrations at all attachments between the subframe and the chassis.

2. The floor cleaning machine of claim 1 wherein the scrubbing means comprises, in combination: at least one brush mounted for rotation about an axis; and means for rotating the brush about the axis.

3. The floor cleaning machine of claim 2 further comprising, in combination: a vacuum squeegee assembly mounted to the subframe; a vacuum system for placing the first tank under vacuum; and conduit means extending between the vacuum squeegee assembly and the first tank.

4. The floor cleaning machine of claim 3 further comprising, in combination: a second tank carried by the chassis for holding floor cleaning solution; and means for dispensing the floor cleaning solution from the second tank to the floor.

5. The floor cleaning machine of claim 4 further comprising, in combination: at least a first battery mounted to the chassis, with at least the moving means being battery powered.

6. The floor cleaning machine of claim 5 wherein the suspension means comprises, in combination: a multiplicity of elastomeric isolator mounts between the chassis and the subframe and arranged in a nonlinear fashion.

7. The floor cleaning machine of claim 6 wherein each of the elastomeric isolator mounts comprises, in combination: a first portion and a second portion integrally attached to the first portion, with the first portion being sandwiched between the subframe and the chassis, with the second portion being insertable into and capturable in a mount aperture formed in one of the subframe and the chassis.

8. The floor cleaning machine of claim 7 wherein each of the elastomeric isolator mounts further comprises, in combination: means for axially compressing the second portion to selectively expand the second portion into a mushroom shape to capture the mount aperture.

9. The floor cleaning machine of claim 8 wherein the axially compressing means comprises, in combination: an axial counterbore extending into the second portion and spaced from the first portion; a washer for abutting with the axial end of the second portion; an axial bore extending through the first and second portions, with the axial counterbore being of a larger diameter than the axial bore; a rigid bushing positioned in the axial bore from the axial end of the first portion to the axial counterbore of the second portion; a securement aperture formed in the other of the subframe and the chassis; and bolt means extending through the securement aperture, the bushing, the axial counterbore, and the washer.

10. The floor cleaning machine of claim 1 wherein the suspension means comprises, in combination: a multiplicity of elastomeric isolator mounts between the chassis and the subframe and arranged in a nonlinear fashion.

11. The floor cleaning machine of claim 10 wherein each of the elastomeric isolator mounts comprises, in combination: a first portion and a second portion integrally attached to the first portion, with the first portion being sandwiched between the subframe and the chassis, with the second portion being insertable into and capturable in a mount aperture formed in one of the subframe and the chassis.

12. The floor cleaning machine of claim 11 further comprising, in combination: a multiplicity of securement apertures formed in the other of the subframe and the chassis, and a multiplicity of bolt means extending through each of the bushings and the securement apertures, with the mount apertures being concentric and spaced from the bolt means.

13. The floor cleaning machine of claim 1 further comprising, in combination: a vacuum squeegee assembly mounted to the subframe; conduit means extending between the vacuum squeegee assembly and the first tank; a vacuum system having an inlet and an outlet, with the inlet in fluid communication with the first tank; and an acoustical tunnel formed in the upper assembly, with the acoustical tunnel defining a closed volume preventing escape of air therethrough, with the closed volume being covered by sound reducing material, with the outlet in fluid communication with the closed volume, with the air escaping from the closed volume in a direction generally opposite to the direction that air is introduced by the outlet into the closed volume.

14. In a machine for cleaning floors including means for movably supporting the machine upon the floor, means for moving the machine upon the floor, means for scrubbing the floor, and at least a first tank for holding floor cleaning solution, an improved suspension system comprising, in combination: a truck, with the movably supporting means mounted to the truck; an upper assembly, with the first tank carried by the upper assembly; and a multiplicity of elastomeric isolator mounts between the truck and the upper assembly and arranged in a nonlinear fashion for dampening the transmission of vibrations at all attachments between the truck and the upper assembly.

15. The floor cleaning machine of claim 14 wherein each of the elastomeric isolator mounts comprises, in combination: a first portion and a second portion integrally attached to the first portion, with the first portion being sandwiched between the truck and the upper assembly, with the second portion being insertable into and capturable in a mount aperture formed in one of the truck and the upper assembly.

16. The floor cleaning machine of claim 15 wherein each of the elastomeric isolator mounts further comprises, in combination: an axial counterbore extending into the second portion and spaced from the first portion; an axial bore extending through the first and second portions, with the axial counterbore being of a larger diameter than the axial bore; a washer for abutting with the axial end of the second portion; a rigid bushing positioned in the axial bore from the axial end of the first portion to the axial counterbore of the second portion; a securement aperture formed in the other of the truck and the upper assembly; and bolt means extending through the securement aperture, the bushing, the axial counterbore, and the washer for axially compressing the second portion to selectively expand the second portion into a mushroom shape to capture the mount aperture.

17. The floor cleaning machine of claim 15 further comprising, in combination: a multiplicity of securement apertures formed in the other of the truck and the upper assembly, and a multiplicity of bolt means extending through each of the bushings and the securement apertures, with the mount apertures being concentric and spaced from the bolt means.

18. In a machine for cleaning a surface comprising, in combination: a frame; means for movably supporting the frame upon the surface; a vacuum squeegee assembly mounted to the frame; a first tank carried by the frame for holding surface cleaning solution; conduit means extending between the vacuum squeegee assembly and the first tank; a vacuum system having an inlet and an outlet; conduit means extending between the inlet of the vacuum system and the first tank; and an acoustical tunnel formed in the frame, with the acoustical tunnel defining a closed volume preventing escape of air therethrough, with the closed volume being covered by sound reducing material, with the outlet of the vacuum system in fluid communication with the closed volume, with the air escaping from the closed volume in a direction generally opposite to the direction that air is introduced by the outlet of the vacuum system into the closed volume.

19. The surface cleaning machine of claim 18 wherein the closed volume has an open end, with the outlet of the vacuum system extending through the open end and into the closed volume, with the open end having a size substantially larger than the outlet, with the air escaping from the closed volume flowing around the outlet of the vacuum system and through the open end.

20. The surface cleaning machine of claim 19 further comprising, in combination: at least a first battery mounted to the frame, with the vacuum system being battery powered, with the acoustical tunnel being generally parallel to and adjacent the battery.

21. The surface cleaning machine of claim 20 wherein the acoustical tunnel is elongated having a gable-shaped cross section.

* * * * *